US009551046B2

(12) United States Patent
Blumenau et al.

(10) Patent No.: US 9,551,046 B2
(45) Date of Patent: Jan. 24, 2017

(54) APPARATUS AND METHOD FOR THE TREATMENT OF A FLAT STEEL PRODUCT, TAKING PLACE IN THROUGHPUT

(75) Inventors: Marc Blumenau, Hagen (DE); Karsten Machalitza, Mulheim (DE); Michael Peters, Kleve (DE); Rudolf Schoenenberg, Daphne, AL (US); Sabine Zeizinger, Mulheim (DE); Martin Norden, Mobile, AL (US)

(73) Assignee: ThyssenKrupp Steel Europe AG, Duisburg (DE)

( * ) Notice: Subject to any disclaimer, the term of this patent is extended or adjusted under 35 U.S.C. 154(b) by 315 days.

(21) Appl. No.: 14/116,530

(22) PCT Filed: Mar. 30, 2012

(86) PCT No.: PCT/EP2012/055854

§ 371 (c)(1),
(2), (4) Date: Feb. 13, 2014

(87) PCT Pub. No.: WO2012/152508

PCT Pub. Date: Nov. 15, 2012

(65) Prior Publication Data

US 2014/0203482 A1 Jul. 24, 2014

(30) Foreign Application Priority Data

May 10, 2011 (DE) ..... 10 2011 050 243

(51) Int. Cl.
*C21D 1/74* (2006.01)
*C21D 9/00* (2006.01)
(Continued)

(52) U.S. Cl.
CPC ..... *C21D 9/0056* (2013.01); *C21D 1/26* (2013.01); *C21D 9/561* (2013.01); *F27B 9/06* (2013.01);
(Continued)

(58) Field of Classification Search
CPC ..... C21D 9/0056; C21D 9/561; C21D 1/26
(Continued)

(56) References Cited

U.S. PATENT DOCUMENTS

| | | | | |
|---|---|---|---|---|
| 3,925,579 | A | 12/1975 | Flinchum et al. | |
| 4,920,998 | A * | 5/1990 | Deitrick | B23K 1/008 137/3 |
| 8,609,192 | B2 | 12/2013 | Borrel | |
| 8,652,275 | B2 | 2/2014 | Leuschner et al. | |
| 2014/0203482 | A1 * | 7/2014 | Blumenau | C21D 9/561 266/44 |

FOREIGN PATENT DOCUMENTS

| | | | |
|---|---|---|---|
| DE | 2522485 | A1 | 12/1975 |
| DE | 102004059566 | B3 | 8/2006 |

(Continued)

OTHER PUBLICATIONS

English language machine translation of JP H0718339, Dec. 1995.*

*Primary Examiner* — Scott Kastler
(74) *Attorney, Agent, or Firm* — The Webb Law Firm

(57) ABSTRACT

An apparatus and a method for the treatment of a flat steel product, taking place in throughput. The apparatus includes an indirectly heated annealing furnace chamber, a conveyor device for continuously conveying the flat steel product over a conveyor path leading from an entry to an exit of the annealing furnace chamber, and nozzle arrangements for feeding atmosphere gas, which is reactive in relation to the flat steel product, into the annealing furnace chamber. A controlled treatment of the flat steel product includes a first nozzle arrangement, from which a gas jet induces a first gas flow towards the entry of the annealing furnace chamber and sweeping over the surface of flat steel product to be treated. A second nozzle arrangement includes a gas jet which induces a second gas flow directed towards the exit of the annealing furnace chamber and sweeping over the surface of flat steel product.

15 Claims, 2 Drawing Sheets

(51) Int. Cl.

| | |
|---|---|
| ***C21D 9/56*** | (2006.01) |
| ***F27B 9/06*** | (2006.01) |
| ***F27B 9/30*** | (2006.01) |
| ***F27D 7/02*** | (2006.01) |
| ***F27D 7/06*** | (2006.01) |
| ***F27D 99/00*** | (2010.01) |
| ***C21D 1/26*** | (2006.01) |

(52) U.S. Cl.
CPC ..... *F27B 9/3005* (2013.01); *F27D 7/02* (2013.01); *F27D 7/06* (2013.01); *F27D 99/0075* (2013.01)

(58) Field of Classification Search
USPC ..... 266/44, 252
See application file for complete search history.

(56) References Cited

FOREIGN PATENT DOCUMENTS

| | | | |
|---|---|---|---|
| JP | 2250927 | A | 10/1990 |
| JP | 2259025 | A | 10/1990 |
| JP | 52106403 | | 12/1990 |
| JP | 718339 | A | 1/1995 |
| JP | 718340 | A | 1/1995 |
| JP | 10306328 | A | 11/1998 |
| JP | 200173026 | A | 3/2001 |
| JP | 2002527622 | A | 8/2002 |
| JP | 2003342645 | A | 12/2003 |
| JP | 2006144104 | A | 6/2006 |
| JP | 2006307244 | A | 11/2006 |
| JP | 200869411 | A | 3/2008 |
| JP | 201013695 | A | 1/2010 |
| WO | 0022363 | A1 | 4/2000 |
| WO | 2009030823 | A1 | 3/2009 |

* cited by examiner

APPARATUS AND METHOD FOR THE TREATMENT OF A FLAT STEEL PRODUCT, TAKING PLACE IN THROUGHPUT

CROSS-REFERENCE TO RELATED APPLICATIONS

This application is the United States national phase of International Application No. PCT/EP2012/055854 filed Mar. 30, 2012 and claims priority to German Patent Application No. 10 2011 050 243.2 filed May 10, 2011, the disclosures of which are hereby incorporated by reference in their entirety.

BACKGROUND OF THE INVENTION

Field of the Invention

The invention relates to an apparatus for the treatment of a flat steel product, taking place in throughput, having an indirectly heated annealing furnace chamber, having a conveyor device for continuously conveying the flat steel product over a conveyor path leading from an entry of the annealing furnace chamber to an exit of the annealing furnace chamber, and having nozzle arrangements for feeding atmosphere gas, which is reactive in relation to the flat steel product, into the annealing furnace chamber.

The invention also relates to a method for treating a flat steel product, in which the flat steel product is conveyed in continuous throughput through an indirectly heated annealing furnace chamber from its entry to its exit, an atmosphere which is reactive in relation to the flat steel product, and which is introduced into the annealing furnace chamber through nozzle arrangements, being maintained in the annealing furnace chamber.

Description of Related Art

When "flat steel products" are referred to here, this means rolling products consisting of steel, which are for example in the form of steel strip, sheet steel or cuttings obtained therefrom.

Inter alia, it is known from DE 25 22 485 A1 that the surface reactivity of steel strips can be conditioned in a controlled way by oxidation. Thus, even those flat steel products which cannot be coated with the necessary reproducibility and absence from defects in the untreated state, owing to the composition of their steel, can have a protective metal layer applied to them by hot-dip coating after controlled surface oxidation.

Products which may be coated in this way with such a layer protecting against corrosion include, for example, strips or sheets which consist of so-called "Advanced High Strength Steels" (AHSS). Besides iron and unavoidable impurities, such steels typically contain (in wt. %) C: 0.01-0.22%, Mn: 0.5-3.0%, Si: 0.2-3.0%, Al: 0.005-2.0%, Cr: up to 1.0%, Mo: up to 1.0%, Ti: up to 0.2%, V: up to 0.4%, Nb: up to 0.2%, Ni: up to 1.0%.

Owing to their industrial importance, many attempts have been made to carry out the pretreatment steps necessary for coating with the protective metal coat economically with the respectively available means.

A particular challenge in terms of plant technology in this case involves the preoxidation of flat steel products in indirectly heated continuous furnaces, so-called "Radiant Tube Furnaces", abbreviated to "RTF". In the case of furnaces of the RTF type, in contrast to furnaces in which an open flame is applied directly against the flat steel product to be treated and the oxidation potential in the atmosphere surrounding the strip in the furnace is influenced by modifying the gas/air mixture which is combusted, gas-heated burners are not used. Instead, the heating of the steel strip is carried out by means of heat radiators which are arranged along the conveyor path of the flat steel product through the annealing furnace chamber of the respective furnace.

In order to permit the desired oxidation of the surface of the flat steel product respectively to be treated in practice in an indirectly heated continuous furnace as well, it has been proposed in DE 10 2004 059 566 B3 to carry out the annealing in an RTF furnace in three steps. The first annealing step is in this case configured in such a way that diffusion of essential alloy constituents to the surface of the strip is substantially avoided. In the next step, an effective iron oxide layer, which prevents further alloy constituents from reaching the surface at the final elevated annealing temperature, is then formed in a controlled way. Thus, during the subsequent annealing treatment in a reducing atmosphere, a pure iron layer is formed which is very highly suitable for a surface-wide and firmly adhering coating of zinc and/or aluminium.

The method described above requires that the preoxidation takes place within an enclosed reaction chamber, into which for example $O_2$ is fed as an oxidant. Generally, in the case of furnaces of the RTF type, the problem then arises of separating the annealing furnace chamber, in which the oxidation is intended to take place, in the region of its entry and exit respectively from the surroundings and a further annealing chamber, subsequently passed through, in which there is a different atmosphere. The challenge in this case consists in delimiting the mutually adjacent chambers of the annealing furnace from one another in such a way that the different atmospheres existing in the chambers are not contaminated by the other respective atmosphere to an extent exceeding a tolerance volume. If a reduction treatment is intended to be carried out in the chamber following the annealing furnace chamber in which the oxidation is carried out, then it is necessary to prevent both escape of the oxidant fed into the oxidation chamber into the reduction chamber and entry of the reducing atmosphere of the reduction chamber into the oxidation chamber. Otherwise, by means of undesired side reactions, the treatment result and consequently the result of the coating carried out after the annealing treatment may be lastingly impaired or it may become more difficult to control the individual annealing steps. Both restrict the process stability and may entail extra consumption of process gases.

WO 2009/030823 A1 discloses a possibility of introducing a gaseous oxidant by means of slotted or perforated steel tubes in a continuous furnace according to the RTF design.

JP 2003-342645 A furthermore describes an example of the way in which an enclosed oxidation zone can be achieved in an annealing furnace configured in chamber design. Undesired contamination of the reduction atmosphere by $O_2$ is in this case intended to be avoided by a mechanical seal in the form of squeeze rollers and by a negative pressure inside the oxidation chamber. This method has the disadvantage that hydrogen unavoidably required for the reduction treatment is drawn from the reduction zone into the oxidation region. As a result, water is formed in the oxidation zone. This reaction binds oxygen present in the oxidation zone, which is consequently no longer available for the actually intended oxidation of the flat steel product surface. Targeted control of the oxidation of the flat steel product surface can therefore be achieved only with difficulty in practical use. In particular, it proves difficult to keep the plant power constant in the event of load changes. Wetting defects or deficient adhesion by the hot-dip coating can result from this. Furthermore, in the case of conventional input by means of slotted or perforated steel tubes, the oxidant has only a weak impulse and can therefore be carried away by the gas flow in the furnace interior before it reaches the flat steel product surface.

SUMMARY OF THE INVENTION

Against the background of the prior art explained above, it was the object of the invention to provide an apparatus and a method of the type indicated in the introduction, with which it is possible to carry out a controlled treatment of the respective flat steel product, taking place in throughput, in an economical and operationally reliable way.

Advantageous configurations of the invention are indicated in the dependent claims and will be explained in detail below, as will the general concept of the invention.

The invention is based on the discovery that it is possible to achieve sealing of the chamber by suitable flow management and adjustment of the oxidation atmosphere inside the annealing furnace chamber. In this way, mechanical sealing by means of rollers or similar measures, such as suction at the entry or exit of the furnace chamber, can be obviated.

To this end, an apparatus according to the invention for the treatment of a flat steel product, taking place in throughput, comprises an indirectly heated annealing furnace chamber through which a conveyor device for continuously conveying the flat steel product over a conveyor path, from an entry of the annealing furnace chamber to an exit of the annealing furnace chamber, extends.

Furthermore, the apparatus according to the invention has a nozzle arrangement for feeding atmosphere gas, which is reactive in relation to the flat steel product, into the annealing furnace chamber.

According to the invention, a first nozzle arrangement is provided, from which a gas jet, which induces a first gas flow directed towards the entry of the annealing furnace chamber and sweeping over the surface of flat steel product to be treated, emerges during the treatment, and a second nozzle arrangement is provided, from which a gas jet, which induces a second gas flow directed towards the exit of the annealing furnace chamber and sweeping over the surface of flat steel product to be treated, emerges during the treatment.

The nozzle arrangements present in the furnace according to the invention are therefore formed in such a way that they generate on the one hand a gas flow which is directed towards the entry of the annealing furnace chamber and, on the other hand, a gas flow which is directed towards the exit of the annealing furnace chamber. What is crucial in this case is that the gas flows are simultaneously oriented, concentrated and dimensioned in such a way that their flow energy is sufficient to reach the exit or entry and at the same time sweep over the flat steel product to be treated.

Correspondingly, in a method according to the invention for treating a flat steel product, in which the flat steel product is conveyed in continuous throughput through an indirectly heated annealing furnace chamber from its entry to its exit, an atmosphere which is reactive in relation to the flat steel product, and which is introduced into the annealing furnace chamber through nozzle arrangements, being maintained in the annealing furnace chamber, according to the invention at least the following working steps are performed:

A first gas flow, directed towards the entry of the annealing furnace chamber and sweeping over the surface of the flat steel product to be treated, is generated by one of the nozzle arrangements, and a second gas flow, directed towards the exit of the annealing furnace chamber and sweeping over the surface of the flat steel product to be treated, is generated by a second nozzle arrangement. These gas flows, flowing in two opposite directions inside the annealing furnace chamber, are therefore directed towards the surrounding atmosphere or an atmosphere present in a further chamber adjacent to the annealing furnace chamber, which is located at the entry opening or exit opening of the annealing furnace chamber. At the same time, the gas flows ensure intensive contact between the flat steel product to be treated and the furnace atmosphere inducing the desired reaction on the flat steel product.

Preferably, the gas forming the atmosphere in the annealing furnace chamber is introduced in such a way that a positive pressure of at least 0.001 bar relative to the ambient pressure is maintained in the annealing furnace chamber during the treatment operation. This positive pressure makes it fundamentally more difficult for ambient atmosphere or the atmosphere of an adjacent chamber to enter the annealing furnace chamber. To this end a control device may be provided, which suitably controls the delivery of atmosphere gas to the annealing furnace chamber in order to maintain the desired positive pressure. The positive pressure in the annealing furnace chamber relative to the surroundings should in this case not exceed 100 mbar, since otherwise there would be a risk that excessive amounts of the annealing furnace chamber atmosphere would flow out through the entry or the exit.

In principle, for the inventive generation of the gas flows in the annealing furnace chamber, it is conceivable to position nozzle bars having one or more outlet openings, for example in combination with flow guide devices, such as metal guide plates, by which the gas flow emerging from the nozzle bars is guided suitably over the flat steel product to be treated in the direction of the annealing furnace chamber entry or exit respectively assigned to it.

A configuration which allows particularly precise guiding of the gas flows generated according to the invention in the annealing furnace chamber, which is at the same time easily adaptable to the respective spatial or process technology requirements, is obtained when the nozzle arrangements contain individual nozzles which each apply a concentrated gas jet that is respectively oriented at a particular incidence angle in relation to the direction of advance of the flat steel product to be treated. With the aid of such individual nozzles, highly turbulently flowing gas flows which come into intensive contact with the flat steel product to be treated, and thus induce the desired reaction on the surfaces of the flat steel product with high intensity, can straightforwardly be generated inside the annealing furnace chamber.

The nozzles of the nozzle arrangements may in this case respectively be adjustable individually in relation to the conveyor path of the flat steel product, in such a way that possible flow losses or a decreasing concentration of the gas flows, formed in the annealing furnace chamber towards the entry or exit of the annealing furnace chamber, are compensated for or corrected by a corresponding impulse, respectively newly occurring in the profile of the flow, of the gas jet emerging from the respective nozzle. To this end, on the one hand, two or more nozzles of the respective nozzle arrangement may be distributed at suitable distances along the conveyor path of the flat steel product to be treated, and on the other hand the incidence angles of the gas jets emerging from the nozzles of a nozzle arrangement may be varied in magnitude in the range of from 0° to 90°.

As nozzles for the introduction of concentrated gas jets for the purpose of generating the gas flows desired according to the invention into the annealing furnace chamber, so-called "jet tubes" as described for example in DE 10 2004 047 985 A1 have proven suitable.

Particularly intensive exchange between the respective gas flow and the flat steel product to be treated is obtained when the gas flows travel spirally around the flat steel product to be treated. In order to generate such a spiral gas flow, in particular flowing highly turbulently, it may be expedient to orient the nozzles of at least one of the nozzle arrangements in such a way that at least one of these nozzles emits a gas jet that is directed towards the lower side of the flat steel product to be treated, while at least one of the nozzles of one of the nozzle arrangements emits a gas jet which is directed towards the upper side of the flat steel product to be treated. In this case, a nozzle on a longitudinal side of the conveyor path, directed towards the lower side of the flat steel product to be treated, the gas jet of which sends the gas flow below the flat steel product to be treated, is optimally assigned to a nozzle positioned on the other longitudinal side, the gas jet of which is directed onto the upper side of the flat steel product to be treated, in order to send the gas jet towards the upper side of the flat steel product to be treated.

The formation of the desired gas flows flowing spirally around the flat steel product to be treated may additionally be reinforced by the longitudinal side surfaces of the annealing furnace chamber being curved concavely as seen in cross section. On the concavely indented longitudinal side surfaces, in particular following a regular curvature, the gas flows striking the longitudinal side walls are guided with minimised flow losses in such a way that a particularly uniform flow vortex travelling around the flat steel product is formed.

By the arrangement and orientation of the nozzles of the nozzle arrangements provided according to the invention, the starting point from which the respective gas flow flows in the direction of the entry or exit of the annealing furnace chamber can additionally be determined. Depending on the pressure of the atmosphere which is respectively present at the entry or exit, it may in this case be expedient to displace the origin of the gas flows in the direction of the entry or exit along the conveyor path of the flat steel product to be treated. A configuration which can be controlled particularly well in terms of control technology is in this case obtained when, in relation to the longitudinal extent of the annealing furnace chamber, the gas flow directed towards the entry and the gas flow directed towards the exit respectively have their origin in the middle of the annealing furnace chamber.

Optimal flow conditions inside the annealing furnace chamber formed according to the invention are obtained when the flow rate of the gas jets respectively emerging from the nozzle arrangements is 60-180 m/s.

In principle, the inventive configuration of an apparatus is suitable for all treatments of flat steel product taking place in throughput, in which a particular state of the surface of the flat steel product is intended to be produced by the intensive contact of the flat steel product, respectively conveyed through the indirectly heated annealing furnace chamber, with a furnace atmosphere defined in a controlled way.

The use of an apparatus according to the invention has been found to be particularly effective when it comprises a plurality of furnace chambers through which the flat steel product to be treated passes successively, at least one of the furnace chambers being formed in the manner according to the invention as explained herein. Thus, the apparatus according to the invention may be incorporated into a line for the preparation of a flat steel product for hot-dip coating. To this end, besides the furnace chamber provided with nozzles in the manner according to the invention as explained herein, the apparatus according to the invention may be combined with at least one further furnace chamber in which the flat steel product to be treated undergoes a further treatment in an atmosphere which differs from the atmosphere of the aforementioned annealing furnace chamber formed according to the invention.

The furnace chamber formed according to the invention is in this case preferably arranged between two annealing furnace chambers. This has the advantage that the flat steel product can initially be brought, in the annealing furnace chamber preceding the annealing furnace chamber formed according to the invention, to a temperature necessary for the treatment in the annealing furnace chamber formed according to the invention, subsequently conveyed through the annealing furnace chamber formed according to the invention and then enter the further annealing furnace chamber following the annealing furnace chamber formed according to the invention, where it undergoes a final treatment.

For the preparation of a flat steel product for hot-dip coating, it may for example be expedient to arrange a further chamber before or after the furnace chamber formed according to the invention. In this case, for example, for subsequent hot-dip coating the surface of the flat steel product may initially be oxidised with a protective metal layer, and subsequently reduced. The apparatus according to the invention may in this case be a treatment line in which the steel strip to be coated is initially oxidised in the first annealing furnace chamber, equipped according to the invention with nozzles, of the indirectly heated annealing furnace and subsequently subjected to a reduction treatment in a second chamber of the indirectly heated annealing furnace, following on directly at the exit of the annealing furnace chamber used for the oxidation. Likewise, the annealing furnace chamber formed according to the invention may be preceded by a further chamber in which the flat steel product is initially heat-treated in an atmosphere which has a reducing effect, before then being subjected to oxidation in the chamber according to the invention and again to a reducing heat treatment in a furnace chamber following on therefrom. The separation of the oxidation atmosphere in the oxidation chamber, formed according to the invention, from the reduction atmosphere in the preceding or subsequent reaction chamber is in this case respectively carried out by the gas flow generated according to the invention in the oxidation annealing furnace chamber and flowing towards the exit of the oxidation annealing furnace chamber, assisted by the positive pressure maintained likewise according to the invention in the oxidation annealing furnace chamber.

In the case in which the annealing furnace chamber formed according to the invention is intended to be used for oxidation of the steel strip, the nozzles of the nozzle arrangements provided according to the invention are connected to an $N_2$ supply and an $O_2$ supply. The $N_2$ or $O_2$ gas flow flowing into the respective nozzle is in this case preferably adjustable, in order to be able to adjust in a controlled way the composition of the atmosphere generated in the annealing furnace chamber. Typically, the gas jet introduced through the nozzles of the annealing furnace chamber equipped according to the invention and provided for the oxidation consists of an $N_2/O_2$ mixture, which consists for the main part of $N_2$ with an $O_2$ fraction of which is 0.01-20 vol. %. Optimal effects are obtained in practice when the oxygen fraction of the $N_2/O_2$ mixture is 0.01-5 vol. %.

The reaction of the flat steel product to be treated with the atmosphere present in the annealing furnace chamber formed according to the invention may be reinforced by the temperature of the flat steel product to be treated being kept in the range of 450-950° C. while it passes through the annealing furnace chamber. Heat losses of the flat steel product due to contact with the gas jets flowing out of the nozzle arrangements provided according to the invention may in this case be prevented by the temperature of the gas jets introduced into the annealing furnace chamber being 100-1050° C.

The invention therefore provides an apparatus for the treatment of a flat steel product, taking place in throughput, in the configuration of which, which is particularly important for practical purposes, a reaction medium, for example an oxidant such as $O_2$ or an $N_2/O_2$ mixture, can be delivered by the use of suitable nozzles fitted inside the annealing furnace chamber, for example so-called jet tubes, so turbulently that at least two spiral gas flows diverging from one another are formed. These spiral flows flow around the flat steel product passing through the annealing furnace chamber. In order to generate the spiral flow inside the annealing furnace chamber, three or more nozzle arrangements are preferably used in the annealing furnace chamber.

BRIEF DESCRIPTION OF THE DRAWINGS

The invention will be explained in more detail below with the aid of exemplary embodiments.

DESCRIPTION OF THE INVENTION

Figure 1:
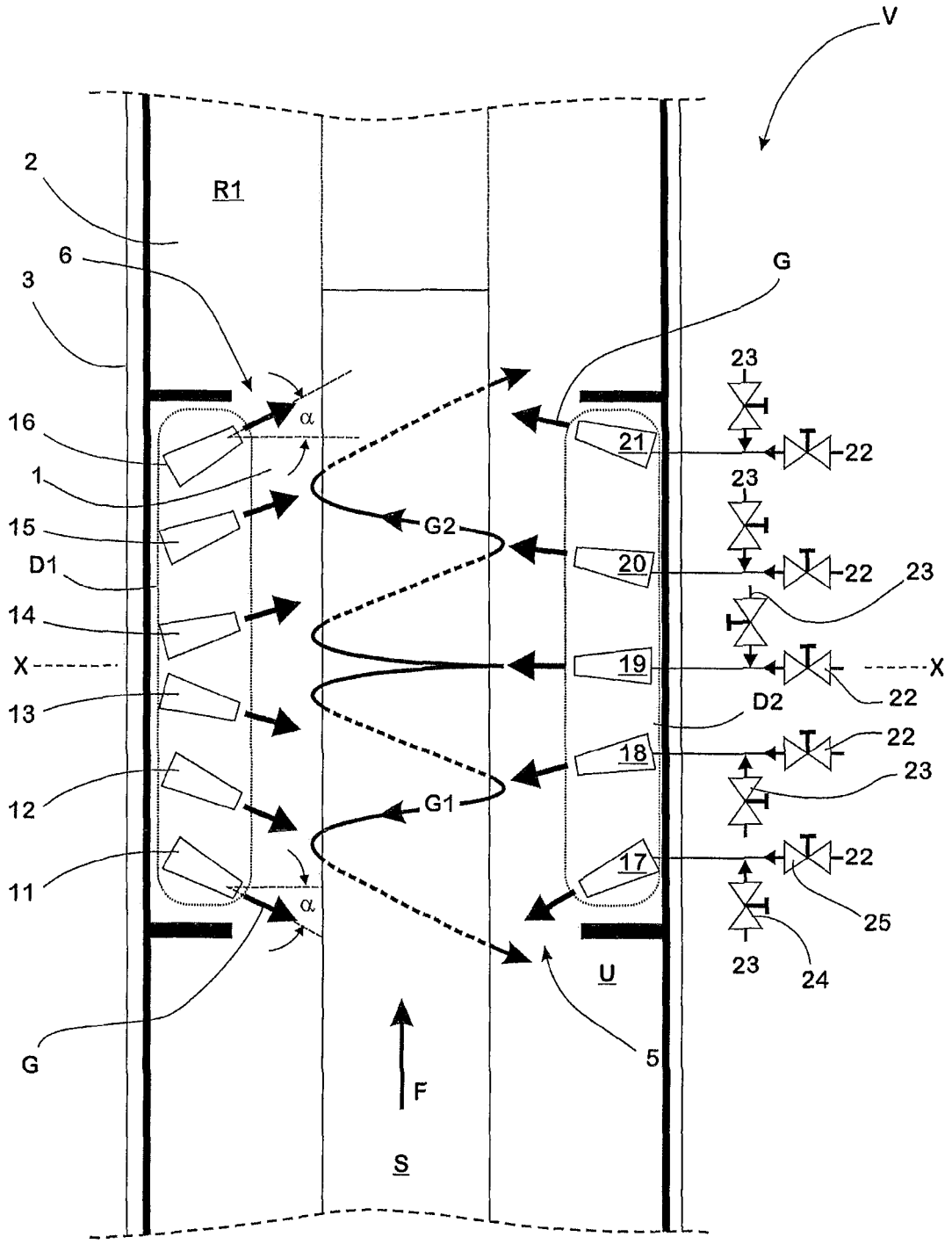
FIG. 1 schematically shows an apparatus for the treatment a flat steel product (S), taking place in throughput, in plan view.

The apparatus V for the treatment of the flat steel product S in the form of a cold- or hot-rolled steel strip, taking place in throughput, comprises a first annealing furnace chamber 1, in which the flat steel product S is subjected to an oxidation treatment, a second annealing chamber 2*a* arranged immediately before the annealing furnace chamber 1 and a second annealing furnace chamber 2*b* connected to the annealing furnace chamber 1. In the annealing furnace chambers 2*a*, 2*b*, the flat steel product S is subjected to a reduction treatment. The annealing furnace chambers 1, 2*a*, 2*b* are part of an indirectly heated annealing furnace 3 of the RTF type, in the middle of which the annealing furnace chamber 1 is located.

The flat steel product S respectively to be treated is transported through the annealing furnace 3 in a conventional way by means of a conveyor device (not represented here for the sake of clarity) on a linearly horizontally extending conveyor path 4 through the annealing furnace chambers 1, 2*a*, 2*b*, and in this case enters the annealing furnace chamber 1 through an entry 5, formed on an end side of the annealing furnace chamber 1, in a conveyor direction F coming from the annealing furnace chamber 2*a*. Through the exit 6 arranged on the opposite end side of the annealing furnace chamber 1, the flat steel product S leaves the annealing furnace chamber 1 and enters the chamber 2*b*, following directly thereon, of the annealing furnace 3. The entry 5 of the annealing furnace chamber 1 thus forms the exit of the annealing furnace chamber 2*a* preceding it. Likewise, the exit 6 of the annealing furnace chamber 1 simultaneously forms the entry of the annealing furnace chamber 2*b* subsequently passed through.

The inner surfaces 7, 8 of the longitudinal walls 9, 10 of the annealing furnace chamber 1 are concavely curved inward with a uniform curvature as seen from its interior.

Nozzle arrangements D1, D2, distributed in the conveyor direction F along the conveyor path 4, are provided in the annealing furnace chamber 1. The first nozzle arrangement D1 in this case comprises six individual nozzles 11-16, while the second nozzle arrangement D2 comprises five individual nozzles 17-21.

The nozzles 11-16 of the nozzle arrangement D1 are positioned along the conveyor path 4 in such a way that the first nozzle 11 is positioned in immediate proximity to the entry 5, the sixth nozzle 16 is positioned in immediate proximity to the exit 6 of the annealing furnace chamber 1 and the remaining four nozzles 12-15 are positioned between the nozzles 11 and 16, while being distributed from one another at regular distances.

In a comparable way, the nozzles 11-21 of the nozzle arrangement 2 are positioned on the opposite side of the conveyor path 4 in such a way that the first nozzles 17 is positioned next to the entry 5, the fifth nozzle 21 is positioned next to the exit 6 of the annealing furnace chamber 1 and the remaining three nozzles 18-20 are positioned between the nozzles 17 and 21, while being distributed from one another at regular distances. As seen in the conveyor direction F, the nozzles 17-21 in this way each lie in the section of the conveyor path in which there is respectively a free space between nozzles 11-16 of the nozzle arrangement D1.

As shown by way of example in FIG. 1 for the nozzles 17-21 of the nozzle arrangement D2, the nozzles 11-21, formed for example as jet tubes of known design, are respectively connected to an $N_2$ supply 22 and an $O_2$ supply 23. The feed of $N_2$ and $O_2$ to the nozzles 11-21, and therefore the gas mixture emerging as a concentrated gas jet G from the nozzles 11-21, can in this case be adjusted individually for each nozzle 11-21 by means of valves 24, 25.

Figure 2:
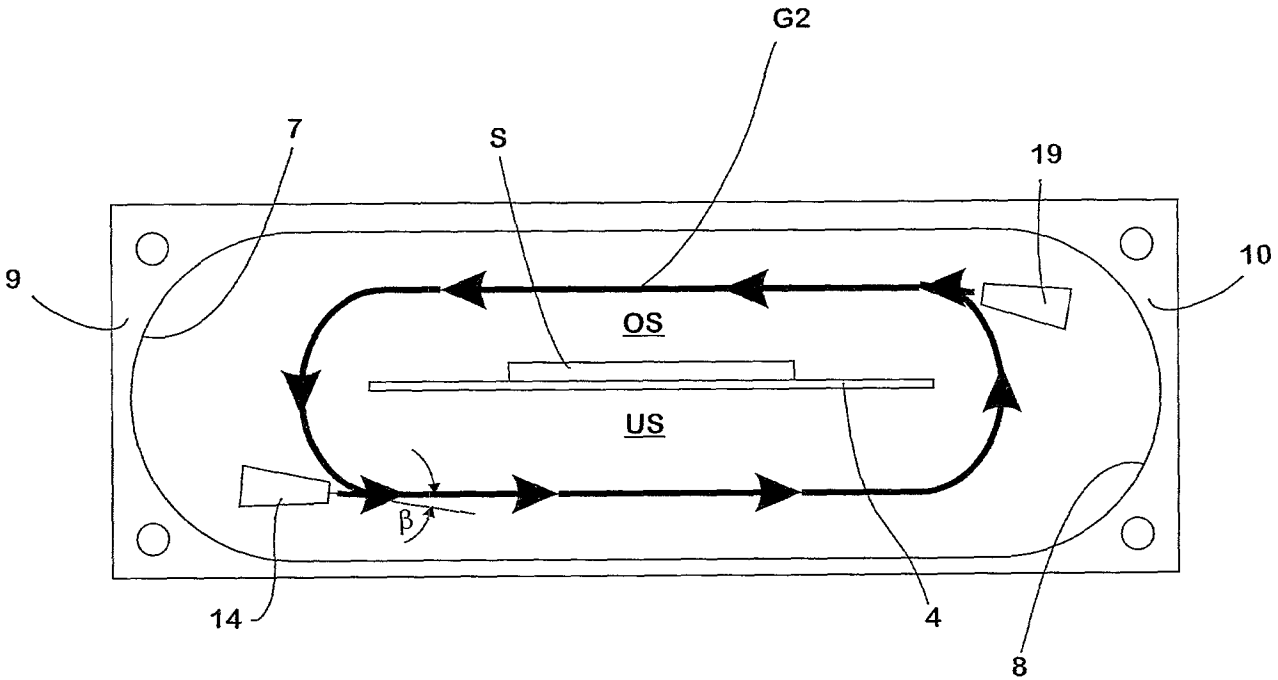
FIG. 2 schematically shows the apparatus according to FIG. 1 in a section along the section line X-X indicated in FIG. 1.

Likewise, for each of the nozzles 11-21, both the incidence angle $\alpha$ at which the gas jet G delivered by the respective nozzle 11-21 flows onto the flat steel product S to be treated, as seen in plan view (FIG. 1), and the attitude angle $\beta$ at which the gas jet strikes the flat steel product S, as seen in cross section (FIG. 2), can be adjusted individually for each nozzle 11-21.

The incidence angle $\alpha$ of the nozzles 11-16, oriented transversely with respect to the conveyor direction F, is varied in magnitude in the angle range of from 30° to 85°, the nozzle 11 assigned to the entry 5 being oriented at an incidence angle $\alpha$ of about 30° towards the entry 5 and the nozzle 16 assigned to the exit 6 being oriented also at an incidence angle $\alpha$ of about 30° towards the exit 6. Likewise, the nozzles 12, 13 following on from the nozzle 11 in the delivery direction F are directed at an incidence angle $\alpha$ towards the entry 5, the incidence angle $\alpha$ of the nozzle 12 being greater than the incidence angle $\alpha$ of the nozzle 11 and the incidence angle $\alpha$ of the nozzle 13, at about 85°, in turn being greater than the incidence angle $\alpha$ of the nozzle 12. The nozzles 14, 15 following on from the nozzle 13 in the conveyor direction F, on the other hand, are oriented like the nozzle 16 towards the exit 6 of the annealing furnace chamber 1. In this case, respectively, the incidence angle $\alpha$ of the nozzle 14 in turn corresponds in magnitude to the incidence angle $\alpha$ of the nozzle 13 and the incidence angle $\alpha$ of the nozzle 15 corresponds to the incidence angle $\alpha$ of the nozzle 12.

The incidence angle $\alpha$, likewise respectively relative to a plane oriented transversely with respect to the conveyor direction F, of the nozzles 17-21 is varied in magnitude in the angle range of from 0° to 30°, the nozzle 17 assigned to the entry 5 being oriented at an incidence angle α of about 30° towards the entry 5 and the nozzle 21 assigned to the exit 6 being oriented in the opposite direction, also at an incidence angle α of about 30°, towards the exit 6. Likewise, the nozzle 18 following on from the nozzles 17 in the conveyor direction F is directed at an incidence angle α towards the entry 5, the incidence angle α of the nozzle 18 being greater than the incidence angle α of the nozzle 17. The nozzle 20 arranged before the nozzle 21 in the conveyor direction F is oriented in magnitude at the same incidence angle α towards the exit 6. The nozzle 19 arranged in the middle of the nozzle arrangement D2, on the other hand, is oriented at an incidence angle α of 0° with respect to the conveyor path 4, so that the gas jet G emerging from this nozzle 19 strikes the flat steel product S to be treated at a right angle.

At the same time, the nozzles 11-16 of the nozzle arrangement D1 are directed towards the lower side US of the flat steel product S and the nozzles 17-21 of the nozzle arrangement D2 are directed towards the upper side OS of the flat steel product S.

Owing to this arrangement of the nozzles 11-21, the gas jets G emerging from the nozzles 11-21 together form two gas flows G1, G2, of which one gas flow G1 flows towards the entry 5 in the form of a flow vortex turbulently travelling spirally around the flat steel product S to be treated, and the other gas flow G2 flows to the exit 6 of the annealing furnace chamber in a similar way as the flat steel product S in the manner of a flow vortex turbulently travelling spirally in the opposite direction.

The origin of the gas flows G1, G2 in this case lies approximately in the middle of the length of the conveyor path 4 in the region of the nozzle 19, the gas jet G of which, emitted transversely with respect to the conveyor path 4 is divided into two partial flows flowing in opposite directions, from which the gas flows G1, G2 are formed, owing to the impulse caused by the gas jets G of the opposition arranged nozzles 13, 14 respectively directed towards the entry 5 and the exit 6.

Owing to each of the gas jets G emerging from the nozzles 13, 18, 12, 17 and 11, the gas flow G1 receives new impulse and additional volume flow, so that its profile travelling spirally around the conveyor path 4 and the flat steel product S transported thereon is maintained with a high concentration as far as the entry 5.

Likewise, the gas jets G of the gas flow G2, which emerge from the nozzles 14, 20, 15, 21 and 16, supply new flow energy and additional volume, so that the gas flow G2 likewise travelling spirally around the conveyor path 4 and the flat steel product S transported thereon reaches the exit 6 of the annealing furnace chamber 1 with high flow energy.

The gas feed to the annealing furnace chamber 1 is controlled overall in such a way that a positive pressure of at least 0.001 relative to the ambient pressure U is constantly maintained in the annealing furnace chamber 1.

Effective sealing of the annealing furnace chamber 1 in relation to the reduction atmosphere R1, R2, respectively containing $H_2$, present in the annealing furnace chambers 2*a*, 2*b* respectively arranged before and after the first annealing furnace chamber in the conveyor direction, is furthermore achieved by virtue of the fact that, in particular, the gas jets G emitted from the nozzles 11, 12 placed closest to the entry 5 displace the reduction atmosphere R1 of the annealing furnace chamber 2*a* approaching the entry 5 away from the annealing furnace chamber 1, and the gas jets G emitted from the displacing nozzles 16, 21 next to the exit 6 displace the $H_2$-containing reduction gas atmosphere R2 of the annealing furnace chamber 2*b* away from the annealing furnace chamber 1. Furthermore, the $O_2$-containing gas jets G of the nozzles 16, 21 or the gas flow G2 flowing out of the exit 6 form $H_2O$ in a controlled way by reaction of $H_2$ and $O_2$ outside the annealing furnace chamber 1, so that reduction atmosphere R1, R2 reaching the respective gas jet G or the gas flow G2 is also reliably prevented from entering the annealing furnace chamber 1.

LIST OF REFERENCES

1 annealing furnace chamber (oxidation annealing furnace chamber)
2*a* annealing furnace chamber (reduction annealing furnace chamber) arranged before the annealing furnace chamber 1 in the conveyor direction F
2*b* annealing furnace chamber (reduction annealing furnace chamber) arranged after the annealing furnace chamber 1 in the conveyor direction F
3 annealing furnace
4 linear conveyor path through the annealing furnace chambers 1, 2
5 entry of the annealing furnace chamber 1
6 exit of the annealing furnace chamber 1
7, 8 inner surfaces of the longitudinal walls 9, 10
9, 10 longitudinal walls of the annealing furnace chamber 1
11-16 individual nozzles of the nozzle arrangement D1
17-21 individual nozzles of the nozzle arrangement D2
22 $N_2$ supply
23 $O_2$ supply
24, 25 valves
α incidence angle
β attitude angle
D1, D2 nozzle arrangements
F conveyor direction of the flat steel, product S
G gas jets
G1, G2 gas flows
OS upper side of the flat steel product S
R1 reduction atmosphere of the annealing furnace chamber 2*a*
R2 reduction atmosphere of the annealing furnace chamber 2*b*
S flat steel product
U surrounding atmosphere
US lower side of the flat steel product S
V apparatus for the treatment of a flat steel product S in the form of a cold- or hot-rolled steel strip, taking place in throughput.

The invention claimed is:

1. An apparatus for the treatment of a flat steel product, taking place in throughput, comprising: an indirectly heated annealing furnace chamber, having a conveyor device for continuously conveying the flat steel product over a conveyor path leading from an entry of the annealing furnace chamber to an exit of the annealing furnace chamber, and having nozzle arrangements for feeding atmosphere gas, which is reactive in relation to the flat steel product, into the annealing furnace chamber, wherein the nozzle arrangements include a first nozzle arrangement, from which a gas jet, which induces a first gas flow directed towards the entry of the annealing furnace chamber and sweeping over the surface of flat steel product to be treated, emerges during the treatment, and a second nozzle arrangement, from which a gas jet, which induces a second gas flow directed towards the exit of the annealing furnace chamber and sweeping over the surface of flat steel product to be treated, emerges during the treatment, and wherein the first and second nozzle arrangements are provided in the annealing furnace chamber and at least one of the nozzles of one of the nozzle arrangements emits a gas jet which is directed towards the lower side of the flat steel product to be treated, while at least one of the nozzles of one of the nozzle arrangements emits a gas jet which is directed towards the upper side of the flat steel product to be treated.

2. The apparatus according to claim 1, further comprising a control device is provided, which controls the delivery of atmosphere gas to the annealing furnace chamber in such a way that a positive pressure of at least 0.001 bar relative to the ambient pressure is maintained in the annealing furnace chamber during the treatment operation.

3. The apparatus according to claim 1, wherein the nozzle arrangements respectively comprise at least one nozzle and an incidence angle of the gas jet emerging from the at least one nozzle of a nozzle arrangement is varied in the range of from 0° to 90°.

4. The apparatus according to claim 1, wherein the orientation of the at least one nozzle is adjustable.

5. The apparatus according to claim 1, wherein the at least one nozzle of the nozzle arrangements is connected to an $N_2$ supply and an $O_2$ supply.

6. The apparatus according to claim 5, wherein the $N_2$ or $O_2$ gas flow flowing into the respective nozzle is adjustable.

7. The apparatus according to claim 1, wherein the longitudinal side surfaces of the annealing furnace chamber are curved concavely as seen in cross section.

8. The apparatus according to claim 1, wherein the annealing furnace chamber is connected to at least one second annealing furnace chamber, in which the flat steel product to be treated undergoes a further treatment in an atmosphere which differs from the atmosphere of the first annealing furnace chamber.

9. A method for treating a flat steel product comprising:

conveying the flat steel product in continuous throughput through an indirectly heated annealing furnace chamber from its entry to its exit; and introducing an atmosphere which is reactive in relation to the flat steel product into the annealing furnace chamber through nozzle arrangements, being maintained in the annealing furnace chamber, wherein a first gas flow, directed towards the entry of the annealing furnace chamber and sweeping over the surface of the flat steel product to be treated is generated by one of the nozzle arrangements, and in that a second gas flow directed towards the exit of the annealing furnace chamber and sweeping over the surface of the flat steel product to be treated, is generated by a second nozzle arrangement, and wherein the first and second nozzle arrangements are provided in the annealing furnace chamber and gas flows travel spirally around the flat steel product to be treated.

10. The method according to claim 9, wherein in relation to the longitudinal extent of the annealing furnace chamber, the gas flow directed towards the entry and the gas flow directed towards the exit respectively have their origin in the middle of the annealing furnace chamber.

11. The method according to claim 9, wherein the gas jet respectively emerging from the nozzles of the nozzle arrangements is an $N_2/O_2$ mixture, the $O_2$ fraction of which is 0.01-20 vol. %.

12. The method according to claim 9, wherein the flow rate of the gas jets respectively emerging from the nozzle arrangements is 60-180 m/s.

13. The method according to claim 9, wherein the temperature of the flat steel product to be treated is 450-950° C.

14. The method according to claim 9, wherein the temperature of the gas jets introduced into the annealing furnace chamber is 100-1050° C.

15. The method according to claim 9, wherein a positive pressure of the reactive atmosphere of at least 0.001 bar relative to the ambient pressure is maintained in the annealing furnace chamber during the treatment.

* * * * *